United States Patent [19]

Spinner et al.

[11] Patent Number: 4,687,272

[45] Date of Patent: Aug. 18, 1987

[54] DEVICE FOR PRESSURE SEALED CONNECTION OF THE OUTER CONDUCTOR OF A COAXIAL LINE

[76] Inventors: Georg Spinner, Am Eichberg 12/8152, Feldkirchen-Westerham; Franz-Xaver Pitschi, Risserkogelstrasse 2/8183, Rottach-Egern; Horst Linnerbauer, Sudetenstrasse 1266/8206, Bruckmuehl, all of Fed. Rep. of Germany

[21] Appl. No.: 878,310

[22] Filed: Jun. 25, 1986

[30] Foreign Application Priority Data

Jun. 25, 1985 [DE] Fed. Rep. of Germany ..... 3522736

[51] Int. Cl.[4] ..... H01R 17/18

[52] U.S. Cl. ..... 439/271; 439/583

[58] Field of Search ..... 339/94 C, 94 R, 94 M, 339/94 A, 177 R, 177 E, 89 C, 90 C, 60 R, 60 M, 60 C

[56] References Cited

U.S. PATENT DOCUMENTS

| | | | |
|---|---|---|---|
| 2,397,735 | 4/1946 | Grieb | 339/94 C |
| 3,170,748 | 2/1965 | Van Horssen | 339/94 C |
| 3,344,227 | 9/1967 | Gilmarten et al. | 339/94 C |
| 3,573,712 | 4/1971 | Shirey | 339/177 E |
| 3,818,120 | 6/1974 | Spinner | 339/177 E |
| 3,915,539 | 10/1975 | Collins | 339/94 C |
| 4,335,928 | 6/1982 | Barrett et al. | 339/94 C |

FOREIGN PATENT DOCUMENTS

| | | | |
|---|---|---|---|
| 1762090 | 5/1957 | Fed. Rep. of Germany . | |
| 1440186 | 10/1968 | Fed. Rep. of Germany . | |
| 2238268 | 2/1974 | Fed. Rep. of Germany | 339/94 C |

*Primary Examiner*—Gil Weidenfeld
*Assistant Examiner*—David Pirlot
*Attorney, Agent, or Firm*—Henry M. Feiereisen

[57] ABSTRACT

A device for pressure sealed connection of the outer conductor of a coaxial line to a connector or the like includes a screw cap which presses the flanged end section of the outer conductor via an intermediate element against an annular contact surface of a plug socket of the connector. Arranged in the contact plane as defined by the annular contact surface between the end section of the outer conductor and the plug socket is an O-ring which thus is accommodated within the HF-space.

6 Claims, 4 Drawing Figures

DEVICE FOR PRESSURE SEALED CONNECTION OF THE OUTER CONDUCTOR OF A COAXIAL LINE

FIELD OF THE INVENTION

The present invention pertains to a device for pressure sealed connection of the outer conductor of a coaxial line.

BACKGROUND OF THE INVENTION

When coupling the outer conductor of a coaxial line e.g. to the plug socket of a connector, it is known to provide a screw cap which presses the flanged end section of the outer conductor via an intermediate element against the plug socket along an annular contact surface.

The use of such connecting devices is, however, not only limited to connectors (or jacks) but is e.g. required also for connecting two coaxial lines by means of a non-detachable cable coupling, for joining a coaxial line to a transition element etc. If required, these connections can easily be provided in water tight manner.

In coaxial lines of large diameter and operating at an inner overpressure up to several bar, it is known to arrange in the joining area of the outer conductor one or several O-rings within the field-free space beyond the contacting surfaces. In general, the contact surfaces are defined by the end section of the outer conductor which end section is rectangularly flanged outwards and for example by a correspondingly mating flange-like counter surface of a plug socket of a connector. The required pressing force for providing intimate contact is obtained by a screw cap screwed on the plug socket and acting via an intermediate element.

Practice has shown, however, that such a device is disadvantageous especially when the coaxial line has a relatively small diameter. This is because during bending or beading of the end section of the outer conductor in outward direction, cracks or fissures or the like are obtained especially along those areas which are primarily subjected to stretching forces i.e. in the area of the outer side of the end section. These cracks are undesirable as the pressure sealed connection is impaired.

It was thus proposed to provide further sealings e.g. in the area of the screw cap and the plug socket or to inject silicon caoutchouc or the like into the entire connecting device, such a pressure sealed connection is, however, expensive and above all unsuitable when a subsequent adjustment of the electrical length of the coaxial line is required by shortening its mechanical length.

OBJECT OF THE INVENTION

It is thus a principal object of the present invention to provide an improved device for pressure sealed connection of the outer conductor of a coaxial line obviating the afore-stated drawbacks.

SUMMARY OF THE INVENTION

This object and others which will become apparent hereinafter are achieved in accordance with the present invention by providing a sealing ring which is arranged between a support insulator and the plug socket of a connector within the high frequency (HF)-space in a plane defined by a contacting surface of the plug socket with the end section of the conductor and which is contacted with the end section along a ring area of a diameter smaller than the diameter of the annular contacting surface.

Despite the fact that the arrangement of the sealing ring preferably an O-ring within the HF-space has been constantly avoided, this arrangement surprisingly causes no problems whatsoever when selecting a suitable material e.g. silicon caoutchouc for the sealing ring.

The present invention has the advantage that the flanged end section of the outer conductor contacts the sealing ring along a ring area which is subjected during the bending step only to relatively minor deformation so that no cracks can occur. The simple structure and the secure sealing allow the device to be assembled on the spot and e.g. to be reassembled after shortening the coaxial line.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
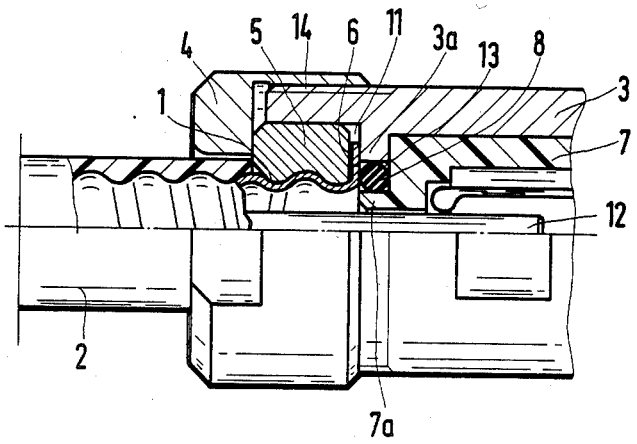
FIG. 1 is a partly sectional view of a first embodiment of a connecting device in accordance with the present invention for coaxial lines with corrugated outer conductor.

In the drawing, a coaxial line is illustrated which by way of a nonlimiting example is joined to a connector. The area of the inner conductor of the coaxial line is only schematically shown and in addition the connector is only illustrated with those parts which are relevant with respect to the understanding of the present invention.

Referring firstly to FIG. 1, there is shown a first embodiment of a device for pressure sealed and tight connection of a coaxial line 2 to a plug socket 3 of an otherwise not shown connector. The coaxial line 2 includes an outer conductor 1 in form of a corrugated pipe whose one end section 6 facing the plug socket 3 is outwardly flanged or beaded at an essentially right angle. With its forward end, the plug socket 3 projects over the end section 6 to define a space 11 therebetween in which an intermediate element in form of a corrugated pipe nut 5 is located. The nut 5 abuts against the end section 6 and is provided with a corrugated bottom portion to fit closely on the mating surface of the outer conductor 1.

The plug socket 3 is provided with an inner collar 3*a* projecting inwardly parallel to the flanged end section 6 which thus extends between the nut 5 and the collar 3*a*. At its outer side, the plug socket 3 is provided with a thread 14 which cooperates with the internal thread of a screw cap or coupling ring 4 so that the latter is displaceable in axial direction along the plug socket 3. The screw cap 4 cooperates with the nut 5 in such a manner that upon turning the screw cap 4 along the plug socket 3, the nut 5 is forced against the end section 6 which thus is brought into intimate contact with the inner collar 3*a* along an annular contact surface.

Enclosed by the plug socket 3 is a hollow-cylindrical support insulator or beaded support 7 which has a central borehole for allowing passage of the inner conductor 12 therethrough. The support insulator 7 is step-shaped such that its forward section 7*a* opposing the inner circumference of the collar 3*a* is of reduced outer diameter and essentially flushes with its axial forward face with the inner collar 3*a*. Thus, between the forward section 7*a* and the collar 3*a* an annular groove 13 is defined which is axially open in direction towards the coaxial line 2.

Accommodated within the annular groove 13 and thus within the HF-space is an O-ring 8 which is made e.g. of silicon caoutchouc. Width and diameter of the annular groove 13 are dimensioned in such a manner that the end section 6 of the outer conductor 1 rests tightly against the O-ring 8 along a ring area which has a smaller diameter than the annular contact surface between the end section 6 and the inner collar 3*a*. During bending or forming of the outer conductor 1 for shaping the flange-like end section 6, this sealing ring area is subjected to relatively minor deformations so that no radial cracks or fissures or the like occur. In the unlikely case such cracks or other irregularities are nevetherless obtained, the pressure sealed connection is, however, still not impaired because of the presence of the O-ring 8 which extends in the contact plane between the support insulator 7 and the inner collar 3*a* of the plug socket 3.

Figure 2:
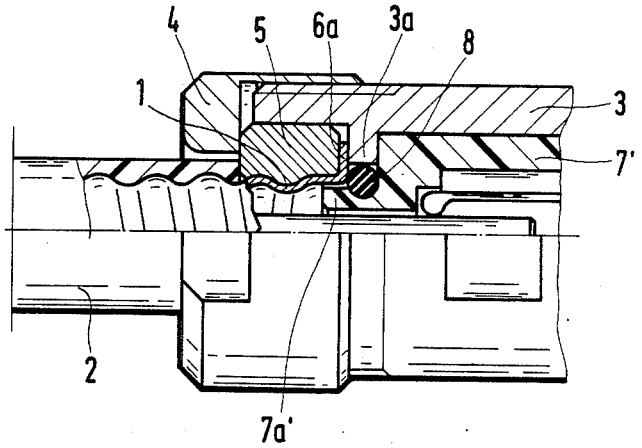
FIG. 2 is a partly sectional view of a second embodiment of a connecting device in accordance with the present invention for coaxial lines with corrugated outer conductor.

Turning now to FIG. 2, there is shown a second embodiment of a connecting device for coaxial lines differing from the first embodiment essentially in the design of the end section of the outer conductor and the support insulator. It should be noted that corresponding parts in FIGS. 1 and 2 are designated by the same reference numeral.

Accordingly, a support insulator 7' is illustrated whose forward section is extended in axial direction to form a centering shoulder 7*a'* projecting by a short length into the outer conductor 1 whose end section 6*a* is flanged in the same manner as described with respect to FIG. 1. In the area along which the centering shoulder 7*a'* extends within the conductor 1, the latter is decorrugated or straightened to define a smooth hollow cylindrical section. Opposite to the collar 3*a*, the centering shoulder 7*a'* is provided with a small radial turned groove for partly accommodating the O-ring 8. Otherwise, the connecting device according to FIG. 2 essentially corresponds to the connecting device of FIG. 1.

Figure 3:
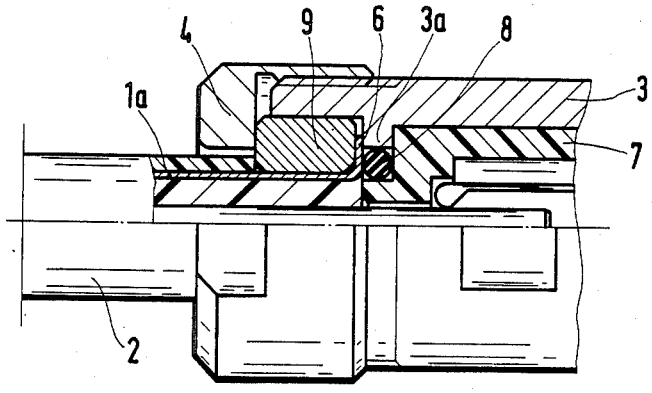
FIG. 3 is a partly sectional view of a third embodiment of a connecting device in accordance with the present invention for coaxial lines with smooth outer conductor.

In FIG. 3, a third embodiment of a connecting device according to the invention is illustrated for a coaxial line 2 which is provided with a smooth outer conductor 1*a* whose end section 6 is flanged outwards at an essentially right angle. Therefore, it is not necessary to provide as intermediate element a corrugated pipe nut 5 as shown in FIG. 1; rather, a simple thrust collar 9 is sufficient for transmitting the force applied by the screw cap 4 to press the flanged end section 6 into contact with the collar 3*a*. Otherwise, the connecting device of FIG. 3 essentially corresponds to the one as illustrated in FIG. 1.

Figure 4:
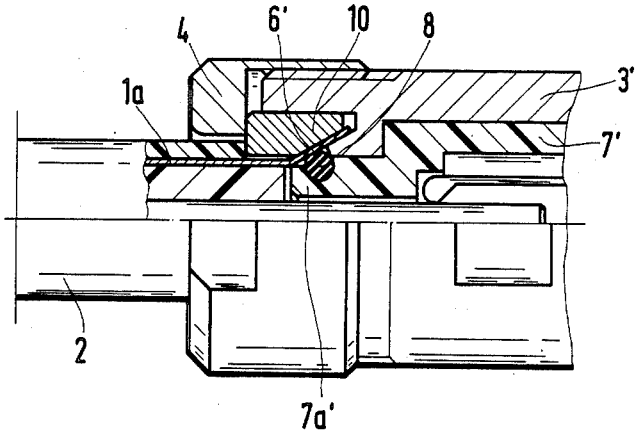
FIG. 4 is a partly sectional view of a fourth embodiment of a connecting device in accordance with the present invention for coaxial lines with smooth outer conductor.

Turning now to FIG. 4 which shows a fourth embodiment of a connecting device for coaxial lines whose outer conductor 1*a* is smooth and includes a funnel-shaped end section 6'. The plug socket 3' of an otherwise not shown connector is provided with an inner collar 3*a'* which includes a conical surface mating with the funnel-shaped end section 6' along a common contacting surface. In view of its funnel-shape, the end section 6' is subjected to an even more reduced deformation, thus preventing the occurrence of cracks while at the same time providing a superior contact with the plug socket 3'.

Acting on the funnel-shaped end section 6' is a clamping cone 10 which presses the end section 6' against the collar 3*a'* when displacing the screw cap 4 along the plug socket 3' in a manner described with respect to FIG. 1.

The support insulator 7' corresponds essentially to the one as illustrated in FIG. 2 and thus is provided with an extended forward section in form of a centering shoulder 7*a'* projecting into the outer conductor 1*a* and including a turned groove for accommodating the O-ring 8. As can be seen from FIG. 4, the centering shoulder 7*a'* extends essentially to the junction between the outer conductor 1*a* and its end section 6'.

As is the case in the other embodiments, the O-ring 8 according to FIG. 4 is also arranged within the HF-space.

While the invention has been illustrated and described as embodied in a Device for Pressure Sealed Connection of the Outer Conductor of a Coaxial Line, it is not intended to be limited to the details shown since various modifications and structural changes may be made without departing in any way from the spirit of the present invention.

What is claimed as new and desired to be protected by Letters Patent is set forth in the appended claims:

1. A device for pressure sealed connection of the outer conductor of a coaxial line to a connector or the like, comprising:

a screw cap forcing one end section of the outer conductor toward an annular contacting surface of a plug socket of the connector;

an intermediate element arranged between said screw cap and the outer conductor, said screw cap acting on said one end section via said intermediate element;

a support insulator surrounded by said plug socket; and a sealing ring arranged between said support insulator and said plug socket within the HF-space in a plane defined by said contacting surface, said sealing ring being contacted by said one end section of the outer conductor along a ring area which is of a diameter smaller than the diameter of said annular contacting surface wherein said one end section of the outer conductor is radially flanged outwardly, said plug socket being provided with an inner collar whose inner circumference defines with said support insulator an axially open annular groove in which said sealing ring is accommodated.

2. A device as defined in claim 1 for a coaxial line whose outer conductor is of corrugated pipe type wherein said intermediate element is a corrugated pipe nut.

3. A device as defined in claim 1 for a coaxial line with a smooth outer conductor wherein said intermediate element is a thrust collar.

4. A device as defined in claim 1 wherein said support insulator is provided with a centering shoulder for the outer conductor, said centering shoulder defining with said circumference of said plug socket said annular groove and being provided with a radial turned groove for receiving said sealing ring.

5. A device as defined in claim 4 for a coaxial line whose outer conductor is of corrugated pipe type wherein said centering shoulder projects into the outer conductor by a certain length along which the outer conductor is straightened to form a hollow cylinder.

6. A device for pressure sealed connection of a smooth outer conductor of a coaxial line to a connector or the like, comprising:

a screw cap forcing one end section of the outer conductor toward an annular contacting surface of a plug socket of the connector;

an intermediate element arranged between said screw cap and the outer conductor, said screw cap acting on said one end section via said intermediate element;

a support insulator surrounded by said plug socket; and a sealing ring arranged between said support insulator and said plug socket within the HF-space in a plane defined by said contacting surface, said sealing ring being contacted by said one end section of the outer conductor along a ring area which is of a diameter smaller than the diameter of said annular contacting surface wherein said one end section of the outer conductor is of conical shape and said plug socket is provided with an inner collar having one mating conical surface defining said annular contact surface, said intermediate element being a clamping cone pressing said one end section against said inner collar along said contact surface, said support insulator including a centering shoulder for the outer conductor whose outer surface is provided with a radial turned groove for receiving said sealing ring.

* * * * *